US007568634B2

(12) United States Patent
Cooke

(10) Patent No.: US 7,568,634 B2
(45) Date of Patent: Aug. 4, 2009

(54) INJECTION NOZZLE

(75) Inventor: Michael P. Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 162 days.

(21) Appl. No.: 11/411,407

(22) Filed: Apr. 26, 2006

(65) Prior Publication Data

US 2006/0243827 A1 Nov. 2, 2006

(30) Foreign Application Priority Data

Apr. 28, 2005 (EP) ..... 05252669

(51) Int. Cl.
*F02M 41/16* (2006.01)

(52) U.S. Cl. ..... 239/96; 239/533.8; 239/533.9; 239/563

(58) Field of Classification Search ..... 239/96, 239/533.3–533.12, 570, 571, 572, 562–564, 239/583, 584
See application file for complete search history.

(56) References Cited

U.S. PATENT DOCUMENTS

| | | | | |
|---|---|---|---|---|
| 4,465,237 | A * | 8/1984 | Kupper | 239/533.3 |
| 6,769,634 | B2 * | 8/2004 | Brenk et al. | 239/533.3 |
| 2002/0073968 | A1 | 6/2002 | Desai et al. | |
| 2004/0055559 | A1 | 3/2004 | Best | |
| 2004/0129804 | A1 | 7/2004 | Potz et al. | |
| 2004/0134465 | A1 | 7/2004 | Boltz | |

FOREIGN PATENT DOCUMENTS

| | | |
|---|---|---|
| EP | 0967382 | 12/1999 |
| WO | WO 2004/033891 | 4/2004 |

* cited by examiner

*Primary Examiner*—Christopher S Kim
(74) *Attorney, Agent, or Firm*—Thomas N. Twomey

(57) ABSTRACT

An injection nozzle for use in delivering fuel to an internal combustion engine includes an outer valve (24) which is engageable with an outer valve seat (38) so as to control fuel delivery into the engine through a first nozzle outlet (26) and an inner valve (32) which is slidable within a bore (30; 130) provided in the outer valve (24) and engageable with an inner valve seat (40) so as to control fuel delivery into the engine through a second nozzle outlet (28). The injection nozzle is provided with a switching valve arrangement (62, 64, 66), for controlling whether fuel is delivered through only one of the first and second outlets (26, 28) or through both of the first and second outlets (26, 28) together, wherein the switching valve arrangement (62, 64, 66) is arranged within the supply passage (22) and defines an inlet side (22*b*), an outlet side (22*a*) and a flow passage arrangement (64) to permit fuel to flow past the switching valve arrangement (62, 64, 66) to the first and second nozzle outlets (26, 28), whereby the switching valve arrangement (62, 64, 66) is operable in response to the pressure drop between the inlet side (22*b*) and the outlet side (22*a*) caused by the flow of fuel past the switching valve arrangement (62, 64, 66).

29 Claims, 9 Drawing Sheets

INJECTION NOZZLE

FIELD OF THE INVENTION

The present invention relates to an injection nozzle for use in a fuel injector for an internal combustion engine. In particular, the injection nozzle includes an inner valve needle arranged within an outer valve, each of the needles controlling the delivery of fuel into the combustion chamber of an internal combustion engine through respective nozzle outlets. The invention also relates to a fuel injector incorporating such an injection nozzle.

BACKGROUND TO THE INVENTION

It is known to provide a fuel injector with an injection nozzle, commonly referred to as a variable orifice nozzle (VON), in which a nozzle body is provided with a blind bore within which a first, outer valve is movable under the control of an actuator. The bore provided in the nozzle body defines a seating surface with which the outer valve is engageable to control fuel delivery through a first set of nozzle outlets provided at a first axial position along the main nozzle body axis. The outer valve is itself provided with a further bore within which a second, inner valve needle is able to move. The inner valve needle projects through the open end of the further bore in the outer valve and is engageable with the seating surface to control fuel delivery through a second set of nozzle outlets provided at a second, lower axial position along the nozzle body axis.

Variable orifice nozzles provide particular advantages for diesel engines, in that they provide the flexibility to inject fuel into the combustion chamber either through the first set of outlets on its own or through both the first and second outlets together. This enables selection of a fuel spray having a larger total fuel delivery area for high engine power modes or a smaller total fuel delivery area for lower engine power modes.

In a first injection stage the outer valve is operable to move alone, so that the outer valve is lifted away from its seating but the inner valve needle remains seated. In a second injection stage movement of the outer valve is transmitted to the inner valve needle, causing the inner valve needle to lift too, in circumstances in which the outer valve is moved through an amount exceeding a predetermined threshold amount. During this second injection stage, both the first and second sets of outlets are opened to give a relatively high fuel delivery rate. If the outer valve is lifted through an amount less than the predetermined threshold amount, the inner valve needle remains seated so that injection only occurs through the first set of outlets at a lower fuel delivery rate. An injection nozzle of this type is described in the Applicant's European patent 0967382 (Delphi Technologies Inc.), or in the Applicant's co-pending European patent application EP 04250132.0 (Delphi Technologies Inc.).

In an injector incorporating an injection nozzle of the aforementioned type, valve operation may be controlled by means of a piezoelectric actuator which allows fine control over the precise position of the outer valve by varying the extent to which the actuator is extended or contracted over the full actuator stroke. In previously proposed variable injection nozzles this has been a requirement to enable the nozzle to be switched between its first and second injection stages. Other types of actuator, however, such as electromagnetic actuators, do not allow such precise valve control so that their use with variable orifice nozzles has not previously been possible.

It is with a view to addressing this limitation that the present invention provides an improved injection nozzle.

SUMMARY OF THE INVENTION

According to a first aspect of the present invention, there is provided an injection nozzle for use in delivering fuel to an internal combustion engine, the injection nozzle including a supply passage for delivering fuel to first and second injection nozzle outlets, an outer valve which is engageable with an outer valve seat so as to control fuel delivery into the engine through the first nozzle outlet and an inner valve which is slidable within a bore provided in the outer valve and engageable with an inner valve seat so as to control fuel delivery into the engine through the second nozzle outlet. The injection nozzle further includes a switching valve arrangement, for controlling whether fuel is delivered through only one of the first and second outlets or through both of the first and second outlets together, wherein the switching valve arrangement is arranged within the supply passage and defines an inlet side, an outlet side and a flow passage arrangement to permit fuel to flow past the switching valve arrangement to the first and second nozzle outlets, whereby the switching valve arrangement is operable in response to the pressure drop between the inlet side and the outlet side caused by the flow of fuel past the switching valve arrangement.

It is one benefit of the present invention that the switching valve arrangement provides a way of controlling whether fuel is injected at a higher rate, through only one outlet (or set of outlets) or through both outlets (or both sets of outlets), without the requirement for a nozzle actuator providing a high degree of valve control. This functionality is achieved without the requirement for a high precision actuator, and simply replies on a variable fuel pressure supply to the nozzle.

Furthermore, there is a good degree of control over when the second valve (be it the inner or outer valve) opens in addition to the first one, as this does not rely on the initial valve moving through a pre-set amount first. In the present invention, system pressure (supply pressure) determines when the second one of the valves opens by providing the switching valve arrangement which is responsive to this supply pressure. The switching valve arrangement is thus operable to switch the injector between its two operating stages; a first stage in which injection occurs at a relatively low pressure and through only one (or a first set) of outlets and a second stage in which injection occurs at a higher pressure and through both (or both sets of) outlets.

The switching valve arrangement preferably includes a switching valve member in the form of a tube, which defines an internal flow passage to allow fuel to flow to the first and second nozzle outlets.

The switching valve arrangement preferably further includes a biasing spring which serves to urge it away from a switching valve seat.

In one embodiment, the outer valve may be urged into engagement with the outer valve seat by means of an outer valve spring. In addition, the outer valve may be arranged to carry an annular member in the outer valve bore through which the force of the outer valve spring is applied to the inner valve to hold the inner valve against the inner valve seat.

In another embodiment, the inner valve is urged into engagement with the inner valve seat by means of an inner valve spring. Here, the inner valve may be arranged to carry an annular member through which the force of the inner valve spring is applied to the outer valve to hold the outer valve against the outer valve seat.

In one embodiment, the switching valve arrangement may be operable between open and closed states so as to initiate movement of only one of the inner and outer valves when fuel pressure delivered to the supply passage is below a supply pressure threshold level and so as to move both the inner and outer valves together when fuel pressure delivered to the supply passage is increased above the supply pressure threshold level. For a given injector with fixed first outlets (the outlets that open first) and a fixed flow path area through the switching valve arrangement, the pressure of fuel delivered to the supply passage determines the pressure drop across the switching valve arrangement.

The injector may be arranged such that the switching valve arrangement is operable between the open and closed states so as to control communication between the supply passage and a switching chamber.

When the switching valve member is in the open state, preferably the switching chamber communicates with the supply passage through a drilling provided in a nozzle housing.

In one further preferred embodiment, movement of the outer valve away from the outer valve seat is initiated upon generation of a pressure wave within the injection nozzle and, in circumstances in which the switching valve arrangement is closed, said movement causes the inner valve to move away from the inner valve seat also.

Alternatively, in another further preferred embodiment at least one of the inner and outer valves has a surface associated therewith which is exposed to fuel pressure within an injection nozzle control chamber, whereby controlling fuel pressure within the injection nozzle control chamber serves to control movement of the inner and outer valves.

Preferably, the injection nozzle control chamber is arranged to communicate continuously with the supply passage through a first restricted flow path.

More preferably, a second restricted flow path communicates with the injection nozzle control chamber, and whereby fuel flows out of the injection nozzle control chamber to a low pressure drain through the second restricted flow path under the control of a control valve.

In one embodiment, it is an end of the inner valve that is exposed to fuel pressure in the injection nozzle control chamber. When the switching valve arrangement is in the open state and fuel pressure within the control chamber is reduced below a control chamber threshold level, the inner valve is caused to lift away from the inner valve seat whilst the outer valve remains seated, thereby to provide injection through only the second outlet.

Preferably, when the switching valve arrangement is in the closed state and fuel pressure within the injection nozzle control chamber is reduced below the control chamber threshold level, movement of the inner valve away from the inner valve seat results in movement of the outer valve away from the outer valve seat also, thereby to provide injection through the first and second outlets together.

For example, the switching chamber may be defined between an upper surface of the outer valve and a facing surface of the inner valve.

Typically, the facing surface of the inner valve may be defined by a collar carried by, or forming a part of, the inner valve.

In another embodiment, it is an end of the outer valve that is exposed to fuel pressure in the injection control chamber. When the switching valve arrangement is in the open state and fuel pressure within the injection nozzle control chamber is reduced below the control chamber threshold level, the outer valve is caused to lift away from the outer valve seat whilst the inner valve remains seated, thereby to provide injection through only the first outlet.

Preferably, when the switching valve arrangement is in the closed state and fuel pressure within the injection nozzle control chamber is reduced below the control chamber threshold level, movement of the outer valve away from the outer valve seat results in movement of the inner valve away from the inner valve seat also, thereby to provide injection through the first and second outlets together.

In a further preferred embodiment, when the switching valve arrangement is in the open state the switching chamber communicates with the supply passage through a drilling provided in the outer valve.

It is convenient to form the switching chamber within the outer valve.

As an alternative to arranging the switching valve arrangement to control communication between the supply passage and a switching chamber, the switching valve arrangement may be operable to control communication between the supply passage and an injection nozzle control chamber.

Here, for example, a surface associated with the outer valve and a surface associated with the inner valve may be exposed to fuel pressure within the injection nozzle control chamber.

Preferably, the injection nozzle control chamber is arranged to communicate continuously with the supply passage through a first restricted flow path.

More preferably, a second restricted flow path communicates with the injection nozzle control chamber, and fuel flows out of the injection nozzle control chamber to a low pressure drain through the second restricted flow path under the control of a control valve.

In a further preferred embodiment, the supply passage communicates with the injection nozzle control chamber, in circumstances in which the switching valve arrangement is open, via a restricted flow path arrangement in the form of a third restricted flow path.

The first, second and third restricted flow paths govern the net flow into (or out of) the injection nozzle control chamber. It is preferable to select the restrictions to fuel flow presented by each of the first, second and third restricted flow paths such that, in circumstances in which the switching valve arrangement is in the open state, the outer valve only is caused to move away from the outer valve seat and, in circumstances in which the switching valve arrangement is in the closed state, the inner valve and the outer valve move together away from the respective inner and outer valve seats.

In accordance with a second aspect of the invention, there is provided a fuel injector for use in an internal combustion engine, including an injection nozzle of the type described in the first aspect when provided with an injection nozzle control chamber, and a control valve for controlling fuel pressure within the injection nozzle control chamber. Preferably, the control valve is a solenoid actuated control valve.

The injector conveniently takes the form of a unit injector further comprising a pumping element and a spill valve for controlling the pressure of fuel supplied to the injection nozzle.

Other preferred and/or optional features of the injection nozzle of the first aspect of the invention may be incorporated in the fuel injector of the second aspect of the invention also.

BRIEF DESCRIPTION OF THE DRAWINGS

The invention will now be described, by way of example only, with reference to the accompanying drawings in which.

DETAILED DESCRIPTION OF THE PREFERRED EMBODIMENTS OF THE INVENTION

Figure 1:
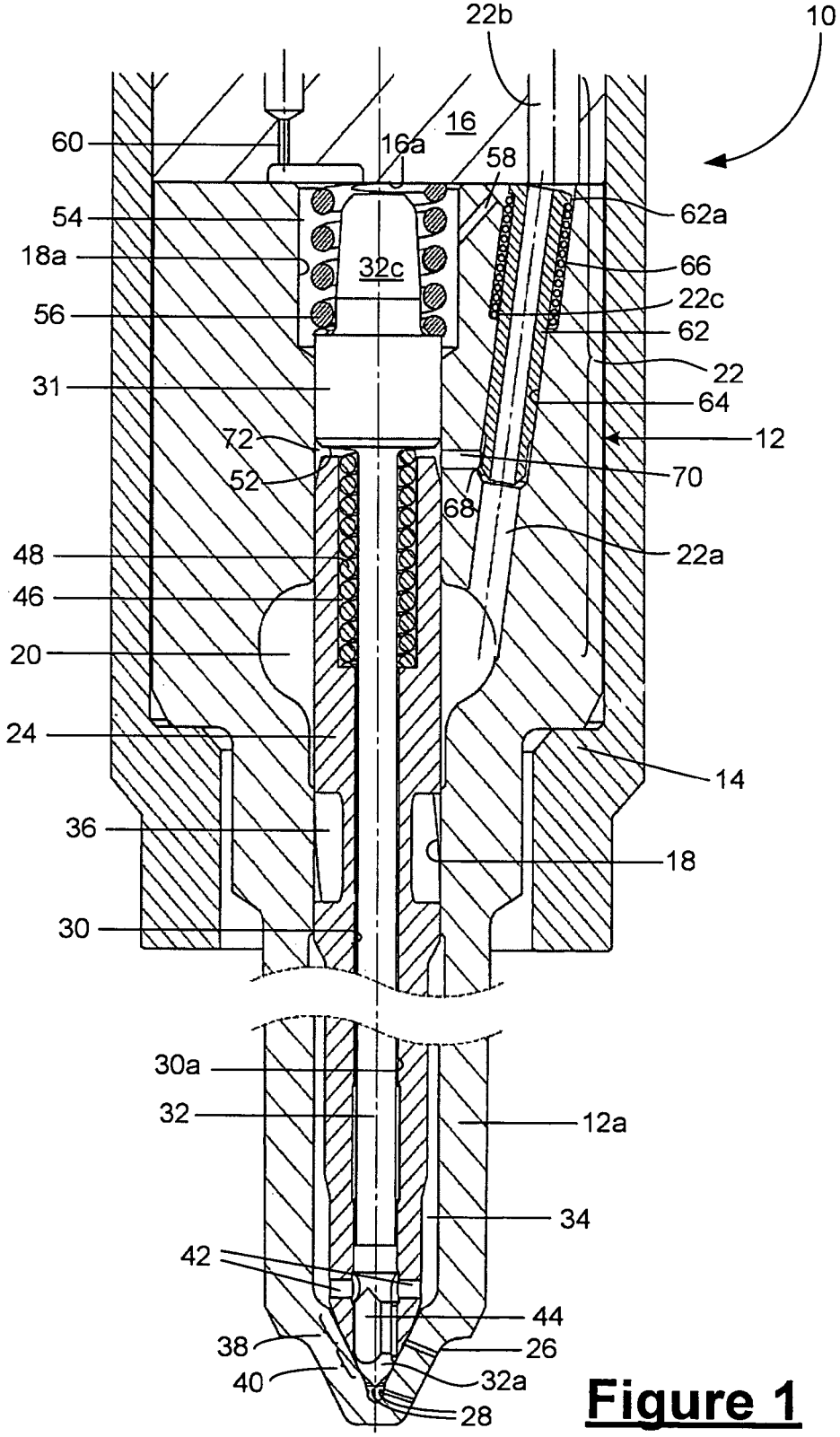
FIG. 1 is a schematic diagram of an injection nozzle of a first embodiment of the present invention when in a closed (non-injecting) state.

An injector for use in a common rail type internal combustion engine typically includes an injection nozzle, as shown in FIG. 1 and referred to generally as 10, and an actuation arrangement for controlling the injection nozzle. FIG. 1 shows only the nozzle part of the injector, as the actuation arrangement may take one of several, conventional forms, as will be described in further details hereinafter.

The injection nozzle 10 includes a nozzle body 12 which is received within an outer sleeve in the form of a cap nut 14. An upper region of the nozzle body 12 is of enlarged diameter and abuts against a second nozzle housing 16, also received within the cap nut 14. The second housing 16 may accommodate at least a part of the actuation arrangement mentioned above. The lower region of the nozzle body is of reduced diameter and terminates in a nozzle tip region 12*a* which extends through the open lower end of the cap nut 14 into the engine cylinder. The nozzle body 12 is provided with a blind bore 18 which defines an annular chamber 20 for receiving fuel from a high pressure supply passage 22, a lower portion 22*a* of which is defined by a drilling through the upper region of the nozzle body 12 and an upper portion 22*b* of which is defined by a drilling through the second nozzle housing 16.

The high pressure supply passage 22 receives fuel from an accumulator volume (not shown), such as a common rail, which is charged with fuel by means of a high pressure fuel pump. The common rail supplies fuel to the injection nozzle in FIG. 1, and to all other injectors of the engine.

A first valve member 24 in the form of an outer valve sleeve is received within the nozzle body bore 18 and is movable therein so as to open and close a first set of nozzle outlets 26 (only one of which is shown) provided in the nozzle tip 12*a*. A second set of nozzle outlets 28 (a plurality of which are shown) is provided in the nozzle tip 12*a* at a lower axial position along the nozzle body axis than the first set of outlets 26. The outer valve 24 defines an outer valve bore 30 within which a second valve member 32, in the form of an inner valve needle, is received in a concentric manner. The inner valve needle 32 is movable axially within the outer valve bore 30 so as to control opening and closing of the second set of nozzle outlets 28.

The outer surface of the outer valve 24 defines, together with the internal surface of the nozzle body bore 18, a delivery chamber 34 for receiving fuel from the annular chamber 20 via slots or grooves 36 formed on the outer surface of the outer valve 24. The outer valve 24 is engageable with an outer seating surface 38 (referred to as the outer valve seat), defined by the internal surface of the nozzle body bore 18 in the nozzle tip region 12*a*, so that when the outer valve 24 is seated against the outer valve seat 38 there is no fuel injection into the engine cylinder through the first outlets 26. When the outer valve 24 is lifted away from the outer valve seat 38 fuel is able to flow through the first outlets 26 into the engine cylinder.

The inner valve needle 32 is engageable with an inner seating surface 40 (referred to as the inner valve seat), which is also defined by the internal surface of the nozzle body bore 18 in a region axially below the outer valve seat 38. In such circumstances, fuel is unable to flow through the second outlets 28 into the engine cylinder. When the inner valve needle 32 is lifted away from the inner valve seat 40, fuel injection through the second outlets 28 takes place. When the inner valve needle 32 is lifted away from the inner valve seat 40, fuel is able to flow to the second outlets 28 by virtue of two flow routes from the delivery chamber 34; a direct flow route past the exposed outer valve seat 38 and an indirect flow route through radial cross drillings 42 provided in the outer valve 24. The radial cross drillings 42 communicate with flats or grooves 44 provided on the inner valve needle 32 to complete the indirect flow path to the second outlets 28.

Although not shown in detail in FIG. 1, the outer valve seat 38 for the outer valve 24 may take the form of a twin-valve seating as described in our co-pending European patent application 04250132.0. It is not visible in the accompanying drawings, but the outer valve 24 is shaped to define a first (upper) outer valve seating line located upstream of the first outlets 26 when the valve is seated, and a second (lower) outer valve seating line located downstream of the first outlets 26 when the outer valve needle 24 is seated (i.e. one seating line on either side of the first outlets 26). The outer valve 24 is provided with a grooved or recessed region to define, at respective upper and lower edges thereof, the upper and lower seating lines. The upper and lower seating lines of the outer valve 24 engage with the outer valve seat 38 at respective upper and lower seats thereof, the upper seat being of larger diameter than the lower seat due to its higher axial position.

In the illustration shown, the inner valve needle 32 is provided with an enlarged head 32*a*, of approximately part-spherical form, to engage with the inner valve seat 40. In an alternative embodiment, however, the inner valve needle 32 may engage with the inner valve seat 40 in a similar manner to that of the outer valve 24, by providing the inner valve needle 32 with a grooved or recessed region to define, at respective upper and lower edges thereof, upper and lower inner valve seating lines. In this case, an additional flow route is required through the inner valve needle 32 to allow fuel to flow from the delivery chamber 34 to the second outlets 28 when the inner valve needle 32 is lifted.

The outer valve bore 30 includes a lower region 30*a* having a substantially constant diameter along its length, whilst at the upper end of the outer valve 24 the bore 30 includes a region of enlarged diameter which defines a first chamber 46 for housing an outer valve spring 48. A lower end of the outer valve spring 48 abuts a step 50 in the outer valve bore 30 located between the lower and upper regions thereof, i.e. at the bottom of the spring chamber 46, by which means the outer valve spring 48 serves to urge the outer valve 24 towards the outer valve seat 38 (i.e. tending towards a closed state). Various thrust surfaces are provided on the outer valve 24 (not identified) which, when subjected to fuel pressure within the delivery chamber 34, experience a lifting force to oppose the force due to the outer valve spring 48, tending to lift the outer valve 24.

An upper end of the spring 48 abuts a surface of an enlarged collar 31 carried by, or forming a part of, the inner valve needle 32. The enlarged collar 31 carries a projection 32*c* which protrudes into a second spring chamber 54 defined within an enlarged diameter region 18*a* of the nozzle body bore 18 at its upper end. The upper end of the projection 32*c* is exposed to fuel pressure within the control chamber 54 and defines a surface associated with the inner valve needle 32 to which a hydraulic force is applied, tending to close the inner valve needle 32. The second spring chamber 54 houses a second spring 56 which also serves to urge the inner valve needle 32 into engagement with its seating 40 (i.e. tending towards a closed state). In use, engagement between the upper end of the projection 32*c* and a stop surface 16*a* defined by the second housing, provides a limit to the extent of movement of the inner valve needle 32 away from the inner valve seat 40.

In an alternative embodiment, the inner valve needle 32 may carry a separate component, or be coupled to a separate component, to define the surface exposed to fuel pressure in the control chamber 54.

The second spring chamber 54 takes the form of a fuel pressure control chamber. Typically, fuel pressure within the control chamber 54 is controlled by means of a control valve arrangement (not shown) which is operable either to allow the control chamber 54 to communicate with a low pressure fuel drain or to block communication between the control chamber 54 and the drain. The control chamber 54 communicates with the high pressure supply passage 22 via a first restricted drilling 58 provided in the upper end of the nozzle body 12. The first restricted drilling 58 allows a continuous flow of fuel into the control chamber 54 to ensure the valves 24, 32 are able to close.

A second restricted drilling 60 out of the control chamber 54 forms a part of the flow path for fuel to the low pressure drain. The relative dimensions of the first and second drillings 58, 60 determine the minimum pressure level to which fuel within the control chamber 54 can drop when the control valve is actuated to open communication between the control chamber 54 and the low pressure drain. This, in turn, determines the timing and rate of opening movement of the valves 24, 32, as described further below.

The control valve for controlling fuel pressure within the control chamber 54 typically takes the form of an electromagnetic valve which is operable by an actuation arrangement in the form of an electromagnetic actuator. By de-energising and energising a solenoid winding of the actuator, the control valve is caused to move. Such an electromagnetic control valve, and method of controlling control chamber pressure, would be familiar to a person skilled in this field of technology. Further details can be found, for example, in our co-pending European patent application EP 0740068 A.

It is a particular feature of the injection nozzle of the present invention that it is provided with a switching valve arrangement to enable selective injection through either one set of outlets on its own (i.e. outlets 26 or 28) or through both sets of outlets together. In this particular embodiment, the switching valve arrangement is arranged to enable either injection through the second outlets 28 only, or through both sets of outlets 26, 28 together.

To provide the aforementioned function, the high pressure supply passage 22 is provided with a switching valve arrangement including a switching valve member 62 which is movable within the high pressure supply passage 22, between open and closed states, in dependence upon the pressure of fuel flowing therethrough. In this embodiment, the switching valve member 62 is an elongate valve tube provided with a flow passage arrangement in the form of an internal flow passage 64 between the upstream and downstream regions 22*b*, 22*a* of the supply passage 22. The internal flow passage 64 of the switching valve member 62 therefore defines a part of the high pressure flow path between the common rail and the injector delivery chamber 34.

The supply passage 22 is enlarged part way along its length so as to accommodate a biasing spring 66 within which an upper end of the switching valve member 62 is received. One end of the biasing spring 66 co-operates with an annular head 62*a* of the switching valve member 62, whilst the other end of the biasing spring 66 abuts a step 22*c* along the high pressure supply passage 22. An internal surface of the high pressure supply passage 22, of frusto-conical form, defines a switching valve seat 68 with which a lower end of the switching valve member 62 is engageable to control flow between the high pressure supply passage 22 and an inlet end of a lateral drilling 70 provided in the nozzle body 12. The biasing spring 66 serves to urge the switching valve member 62 away from the switching valve seat 68 to allow fluid communication between the high pressure supply passage 22 and the lateral drilling 70.

An outlet end of the lateral drilling 70 communicates with a further chamber 72 defined between the upper end of the outer valve 24 and the lower surface 52 of the inner valve collar 31. The further chamber 72 will hereinafter be referred to as the 'switching chamber' because opening and closing of the switching chamber 72 results in switching the nozzle between the first and second injection states. Whether the switching valve member 62 is in the closed stated and engaged with the switching valve seat 68, or in the open state and disengaged from the switching valve seat 68, therefore determines whether or not the supply passage 22 communicates with the switching chamber 72, via the lateral drilling 70.

The switching valve member 62 is responsive to the pressure of fuel supplied to the high pressure supply passage 22 and, in particular, to the pressure drop across the internal passage 64. The pressure drop across the internal passage 64 is a function of the flow rate through it, this being determined by the cross sectional area of the passage 64, the pressure of fuel supplied to the supply passage 22 and the diameter of the first set of outlets (either 26 or 28) to open. In particular, for a given injector the pressure drop across the internal passage 64 of the switching valve member 62 will be proportional to the pressure supplied to the supply passage 22. The upper end of the switching valve member 62 experiences a closing force due to high pressure fuel supplied to the upper region 22*b* of the supply passage 22, this force acting against the force of the biasing spring 66 and the net opening force on the other end of the switching valve member 62 due to fuel in the lower region 22*a* of the supply passage 22, to urge the switching valve member 62 against its seating.

For a given injector, if fuel pressure supplied to the high pressure supply passage 22 is below a predetermined threshold amount (referred to as a 'supply pressure threshold level'), and thus the flow rate through the internal passage 64 is below a predetermined threshold amount, the net opening force acting on the switching valve member 62 is sufficient to hold it open, away from the switching valve seat 68. If fuel pressure supplied to the supply passage 22 is greater than the predetermined threshold level, and thus the flow rate through the internal passage 64 exceeds the predetermined threshold amount, the switching valve member 62 will be caused to close.

The manner in which the injection nozzle is operated, so as to provide injection of fuel at either a first rate or a second, higher rate, will now be described with reference to FIGS. 1 to 3.

FIG. 1 shows the injection nozzle when in a non-injecting state in which both the inner valve needle 32 and the outer valve 24 are seated against their respective seats 40, 38. When in the non-injecting state, the control valve for the inner valve needle 32 adopts a position in which communication between the control chamber 54 and the low pressure drain is prevented, so that high fuel pressure exists within the control chamber 54 (by virtue of the first restricted drilling 58). The upper end of the inner valve needle 32 therefore experiences a large hydraulic force which, in combination with the inner valve spring 56, serves to maintain both the inner and outer valves 32, 24 in engagement with their valve seats 40, 38 respectively. In order to hold the outer valve 24 closed, the switching chamber 72 must be held at relatively high pressure.

Fuel is supplied to the high pressure supply passage 22 at a first injectable pressure level which is not so high a pressure level as to cause the switching valve member 62 to close against the switching valve seat 68. The switching valve member 62 thus remains open, so that fuel at the first pressure level is able to flow from the supply passage 22 into the switching chamber 72 to assist the spring force in holding the outer valve 24 closed. Because of the internal flow passage 64 within the switching valve member 62, whether the switching valve member 62 is opened or closed does not influence the flow of fuel through the high pressure supply passage 22 to the downstream regions of the nozzle.

If the control valve for the control chamber 54 is actuated so as to allow communication between the control chamber 54 and the low pressure drain, fuel pressure within the control chamber 54 starts to reduce. A point will be reached at which the forces acting on the inner valve needle 32 tending to urge the inner valve needle 32 away from its seat 40, are sufficient to overcome the now-reduced force acting on the inner valve needle 32 due to reduced fuel pressure within the control chamber 54. At this point, the inner valve needle 32 will start to lift from the inner valve seat 40, allowing fuel within the delivery chamber 34 to flow into the second outlets 28 via the radial drillings 42 in the outer valve 24 and the flats 44 on the outer surface of the inner valve needle 32. The pressure level within the control chamber 54 at which the inner valve needle 32 starts to lift is referred to as the 'control chamber threshold level'. Once fuel pressure within the control chamber drops to the control chamber threshold level, fuel injection therefore takes place through the second outlets 28 at the first, relatively low pressure level.

As the switching valve member 62 is held open under the force of the biasing spring 66 and fuel is able to flow into the switching chamber 72 via the lateral drilling 70, the outer valve 24 is maintained in engagement with the outer valve seat 38, even though the inner valve needle 32 is moving away from the inner valve seat 40. Movement of the inner valve needle 32 is limited by the projection 32*c* engaging the stop surface 16*a* of the second housing 16.

Provided that the pressure supplied to the supply passage 22 (and therefore the flow rate through the switching valve member 62) is below the predetermined threshold level, the pressure drop across the switching valve member 62 during the first injecting stage is insufficient to overcome the force of the biasing spring 66 and the switching valve member 66 remains open. If the pressure drop across the switching valve member 62 were to increase above the threshold level, causing the switching valve member 62 to close against the switching valve seat 68, the first injecting stage would be compromised, as will be apparent from the following description.

In order to terminate injection through the second outlets 28, the control valve is actuated to close communication between the control chamber 54 and the low pressure drain, thereby re-establishing high fuel pressure within the control chamber 54 due to the continuous flow through the first restricted drilling 58. As a result, the inner valve needle 32 is urged into engagement with the inner valve seat 40 to close the second outlets 28.

Figure 3:
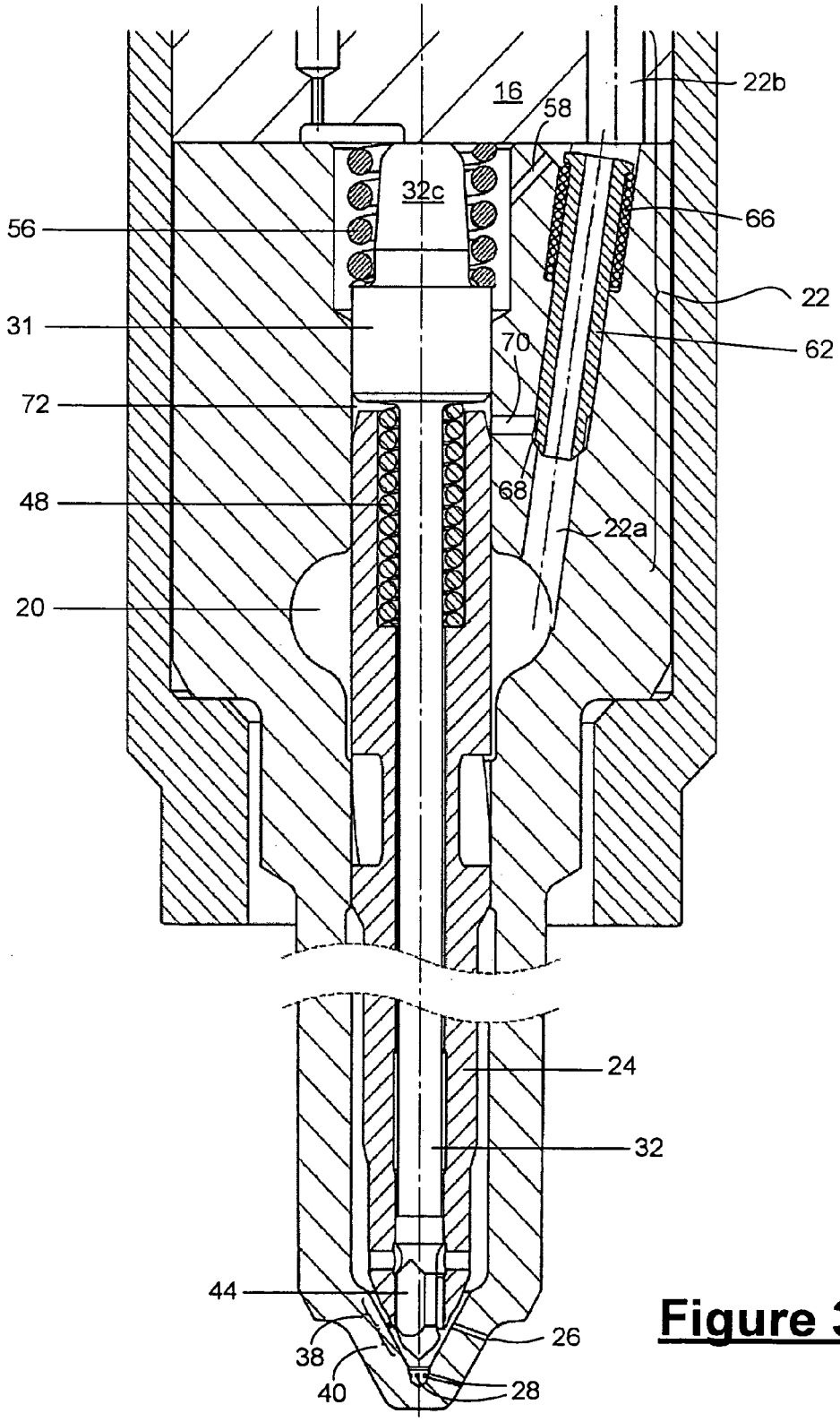
FIG. 3 shows the injection nozzle in FIGS. 1 and 2 when in a second injecting state in which fuel is injected through both the first and a second set of nozzle outlets together.

Referring to FIG. 3, in order to provide a second fuel injection stage, the pressure of fuel supplied to the high pressure supply passage 22 (and hence the flow rate through the switching valve member 62) is increased to a second, relatively high pressure level. The second pressure level is higher than the first pressure level and is selected to be a pressure level sufficient to cause the switching valve member 62 to close against the switching valve seat 68 (i.e. greater than the predetermined threshold level), overcoming the force of the biasing spring 66 and the hydraulic opening force acting on the switching valve member 62 due to fuel within the lower region 22*a* of the supply passage 22.

As the switching valve member 62 is caused to close, the flow of fuel into the switching chamber 72 through the lateral drilling 70 is prevented. In circumstances in which the control valve is actuated so as to reduce control chamber pressure to below the control chamber threshold level, the inner valve needle 32 starts to lift and the volume of the switching chamber 72 will increase as the inner and outer valves 32, 24 start to separate. Fuel pressure within the switching chamber 72 therefore starts to reduce and, as a result, the force acting to keep the outer valve 24 closed (the force due to fuel pressure within the switching chamber 72 acting in combination with the force of the outer valve spring 48) is insufficient to overcome the lifting force acting on the outer valve thrust surfaces. At this point the outer valve is also caused to lift from the outer valve seat 38 to allow fuel injection into the engine, at the second pressure level, through both the first and second outlets 26, 28 together.

It is a particular feature of the twin-valve seating of the outer valve 24 that a greater flow fuel rate is possible when compared to a conventional VCO-type nozzles having a single seat, as flow to the outlets 26 occurs through two flow routes; the first flow route past the upper seating line, directly from the delivery chamber 34, and the second flow route past the lower seating line, from the delivery chamber 34 via the radial drillings 42 and the flats 44. In addition, as fuel is permitted to flow into the outlets 26, 28 from both upstream and downstream directions, the balance of the fuel spray injected into the combustion chamber is improved. The benefits of providing a twin-seat such as this are described in further detail in European patent application no. 04250132.0.

In order to reduce the injection pressure level, or to reduce the injection rate, the pressure of fuel supplied to supply passage 22 may be reduced to the first pressure level again. As a consequence, the switching valve member 62 will be caused to open under the force of the biasing spring 66 and the build up of pressure within the switching chamber 72 will cause the outer valve 24 to close. The mode of injection is therefore switched back to the first injection stage by altering the pressure of fuel supplied to the supply passage 22.

In order to terminate injection completely, the control valve is actuated so as to allow fuel pressure within the control chamber 54 to increase, as described previously.

In an alternative embodiment, the injection nozzle may be configured so that the fuel pressure wave arriving in the nozzle initiates valve movement, in a manner known in more conventional injection nozzles. In this embodiment, the control valve for the control chamber 54 is not required and the outer valve spring is enlarged to increase the biasing force holding the inner valve needle 32 closed. Here, the injection nozzle may form a part of a so-called unit injector, as opposed to a common rail injector, where a dedicated fuel pump is provided to supply pressurised fuel to the nozzle.

The outer valve 24 is appropriately dimensioned, and the outer valve spring 48 appropriately selected, so that when the outer valve 24 experiences the pressure wave it is caused to lift away from the outer valve seat 38. For relatively low injection pressures, the switching valve member 62 remains open so that movement of the outer valve 24 relative to the inner valve needle 32 is permitted, as described previously, and only the outer valve 24 opens to allow injection through the first outlets 26 only. In this embodiment, therefore, it is the outer valve 24 that is caused to lift first to inject fuel at a relatively low injection pressure.

If the pressure of fuel supplied to the supply passage 22 is increased above the predetermined threshold level, and thus the pressure drop across the switching valve member 62 is increased above its predetermined threshold level, the switching valve member 62 will be closed to close communication between the supply passage 22 and the switching chamber 72. As the outer valve 24 lifts away from the outer valve seat 38, the inner valve needle 32 will also be caused to lift as a consequence of fuel being trapped within the switching chamber 72. Fuel injection therefore occurs at the higher injection pressure through both the first and second outlets 26, 28.

In a further alternative embodiment of the invention (also not shown) the control means for actuating movement of the inner and outer valves 32, 24 may include a control valve for controlling fuel pressure in the control chamber 54 (as in FIGS. 1 to 3) in addition to a spill valve for controlling the pressure of fuel delivered to the supply passage 22. The nozzle may therefore form part of a unit injector, in which a dedicated fuel pump supplies pressurised fuel to the nozzle. The spill valve controls whether the pump of the unit injector pressurises fuel to be delivered to the nozzle, fills with fuel from a low pressure drain or expels fuel to the low pressure drain.

In this embodiment, injection is initiated in the manner described previously, and whether injection occurs through only the first outlets 26 (by opening the outer valve 24) or the second outlets 28 (by opening the inner valve needle 32) is determined by the pressure of fuel supplied to the supply passage 22. Termination of injection occurs when the control valve is actuated to increase fuel pressure within the control chamber 54 at or about the same time as the spill valve is opened to allow fuel in the high pressure supply passage 22 to flow to a low pressure drain. Actuation of both valves together results in rapid closure of the valve(s). Operation of a unit injector having a spill valve and a control valve is well known in this field of technology and the mode of operation would be familiar to a person skilled in the art. The key feature of the present invention, over and above the known unit injector of this type, is the provision of the switching valve 62, which is responsive to fuel pressure, and thus flow rate, in the supply passage 22 and provides a means for allowing selective movement of either the outer valve 24 on its own, or the inner valve needle 32 and the outer valve 24 together, to control whether fuel is injected through only the first outlets 26 or both the first and second outlets 26, 28 together.

In this respect, it should be appreciated that it is not essential that the switching valve member 62 is in the form of a tube having an internal through bore. Alternatively, for example, the switching valve member 62 may take the form of an elongate member provided with one or more flow passages, for example grooves or flutes, defined on its external surface. In one embodiment, (not shown) the elongate member may be substantially cruciform in cross section. Thus, the flow of fuel past the switching valve member 62, that is to say, through the flow passages, determines the pressure drop across the valve and, hence, the injection state.

Figure 4:
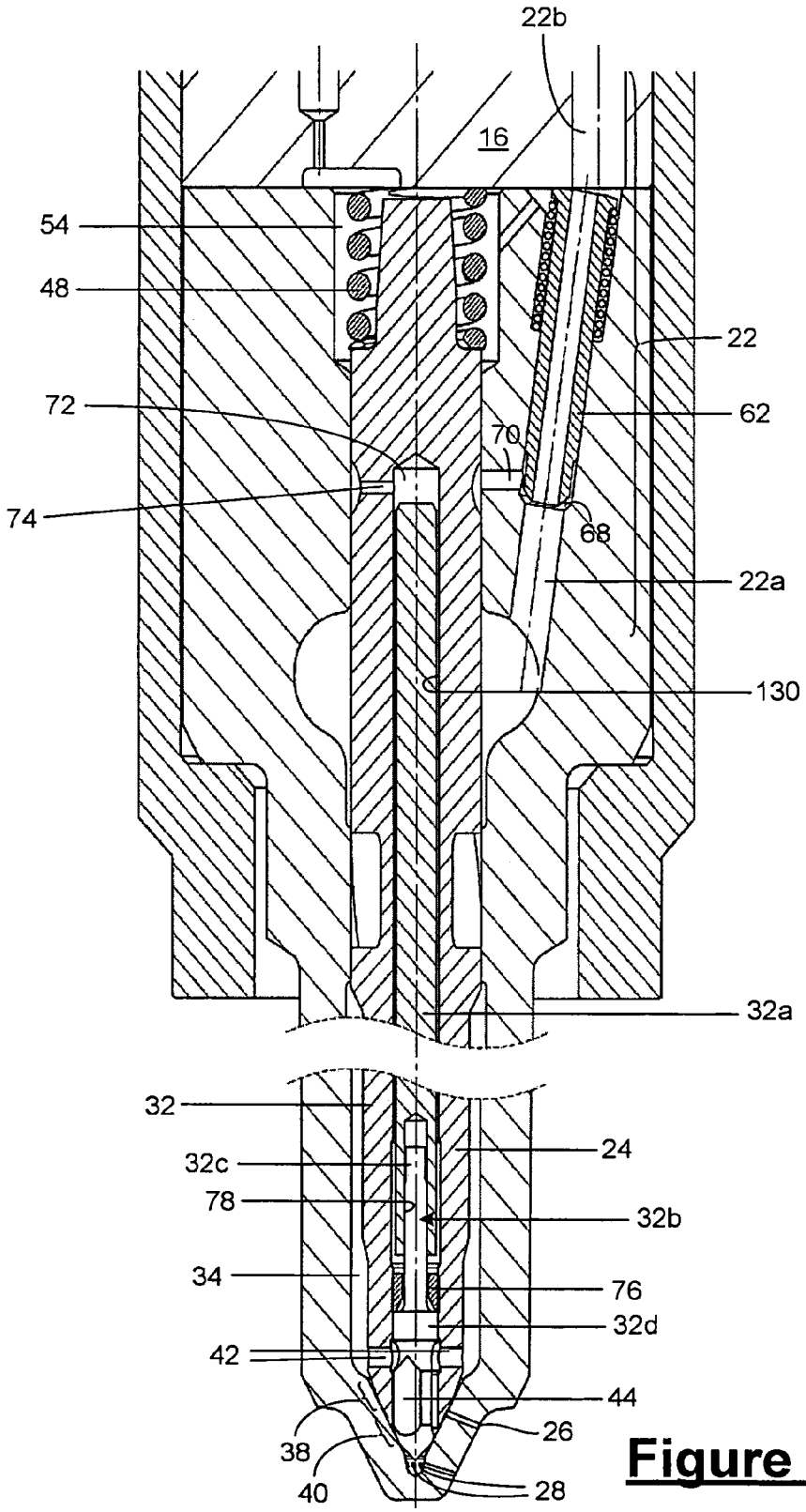
FIG. 4 is a schematic diagram of an injection nozzle of a second embodiment of the present invention when in a closed (non-injecting) state.
Figure 5:
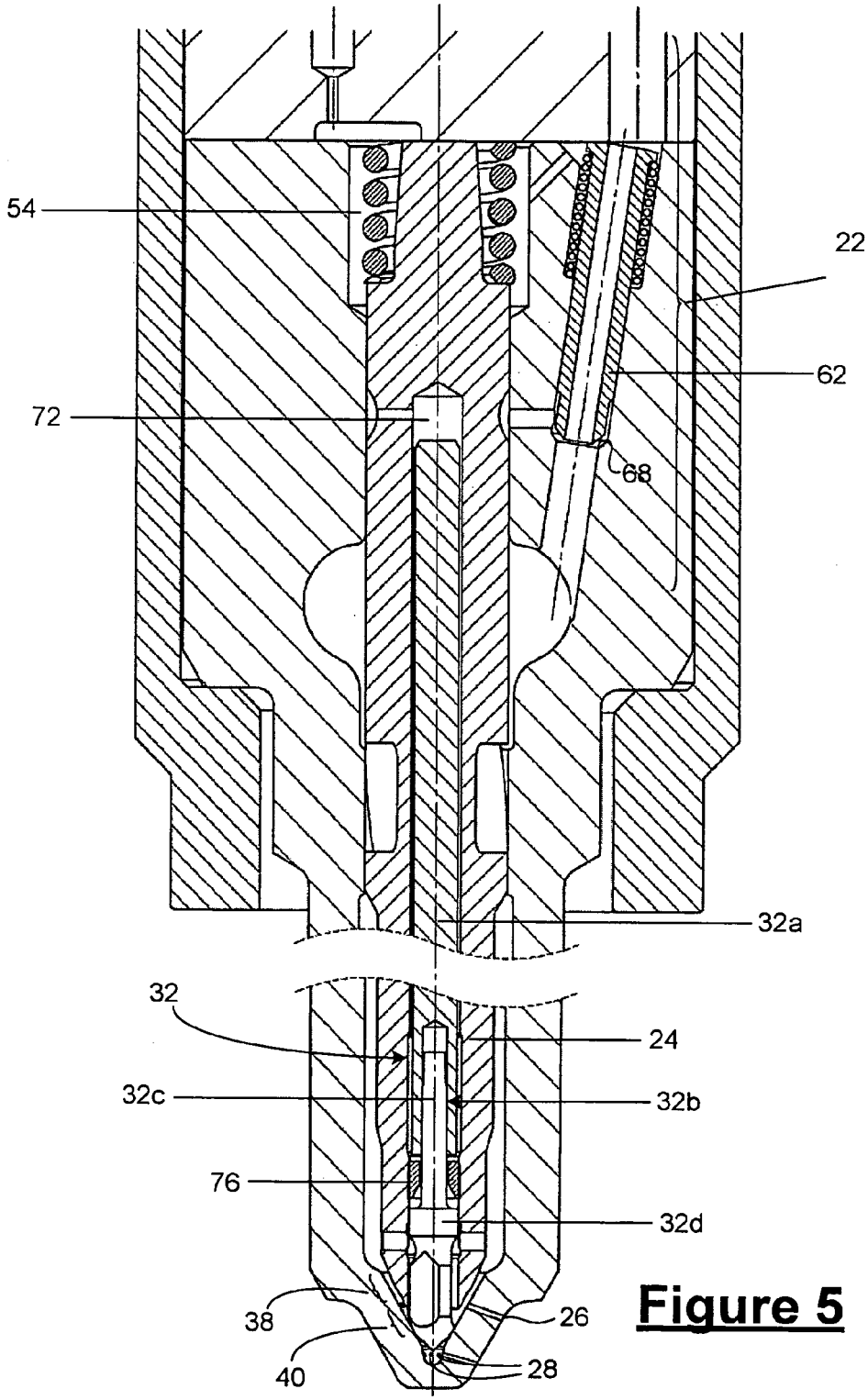
FIG. 5 shows the injection nozzle in FIG. 4 when in a first injecting state in which fuel is injected only through a first set of nozzle outlets.
Figure 6:
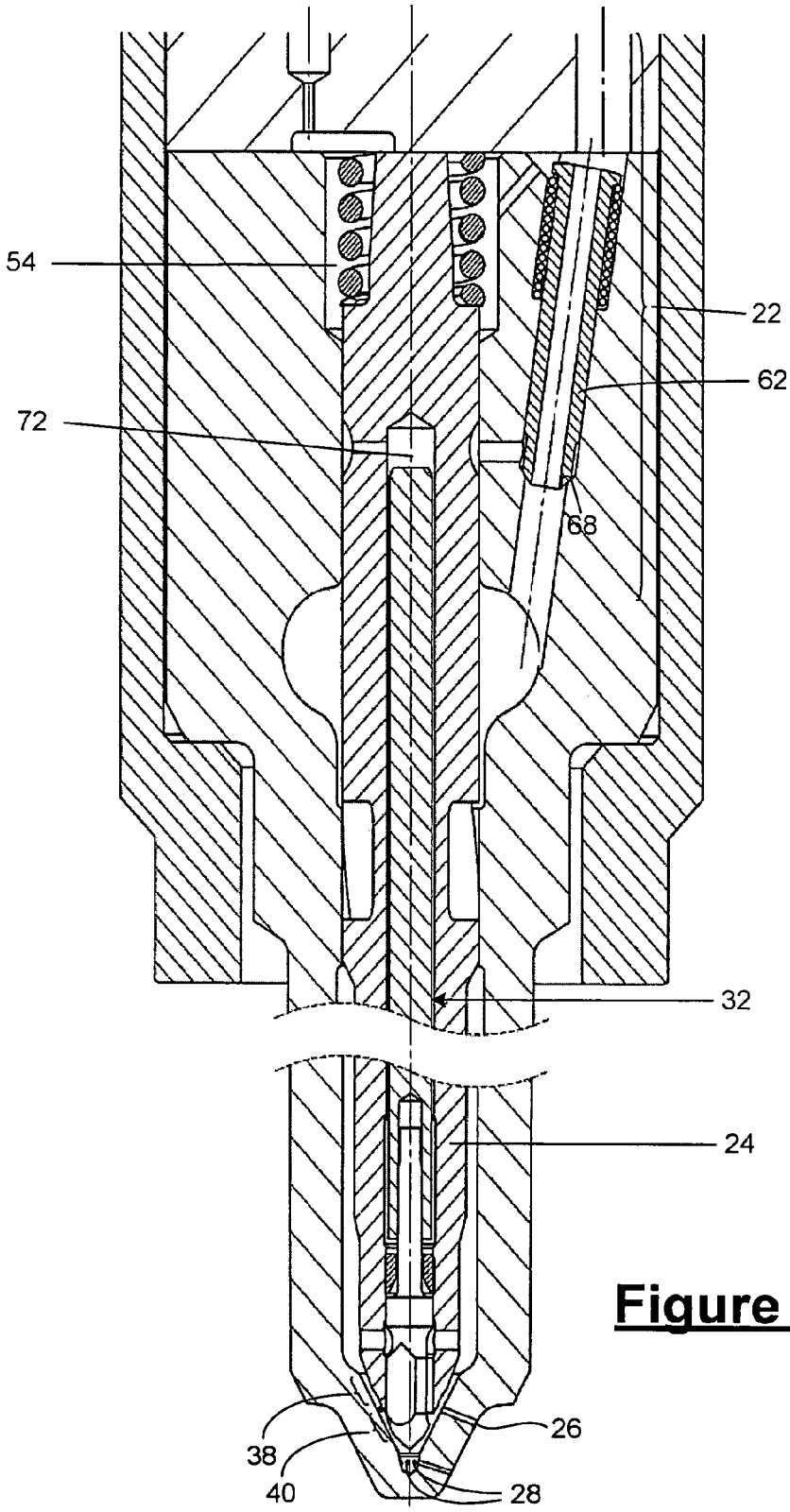
FIG. 6 shows the injection nozzle in FIGS. 4 and 5 when in a second injecting state in which fuel is injected through both the first and a second set of nozzle outlets together.

FIGS. 4, 5 and 6 show an alternative embodiment of the invention in which the location of the switching chamber 72 is different. Like parts of the injection nozzles in FIGS. 1 to 3 and FIGS. 4 to 6 will be identified with like reference numerals and will not be described in detail again. In this embodiment, it is the outer valve 24 that is exposed to fuel pressure within the control chamber 54, rather than the inner valve needle 32 as in FIGS. 1 to 3.

Referring to FIG. 4, the second embodiment of the invention is shown in a non-injecting state in which both the inner and outer valves 32, 24 are seated against their respective valve seats 40, 38. Here, the control valve for the control chamber 54 is in the position in which communication between the control chamber 54 and the low pressure drain is prevented, so that the control chamber 54 is at relatively high pressure.

The outer valve 24 is provided with a blind bore 130, rather than a through bore, which receives the inner valve needle 32 so that the blind end of the bore 130, together with the upper end of the inner valve needle 32, together define the switching chamber 72. The switching chamber 72 communicates with the supply passage 22, via the lateral drilling 70 and a further drilling 74 provided in the outer valve 24, in circumstances in which the switching valve member 62 is unseated. Communication between the supply passage 22 and the lateral drilling 70 is opened and closed by means of the switching valve member 62 in the manner described previously.

Figure 2:
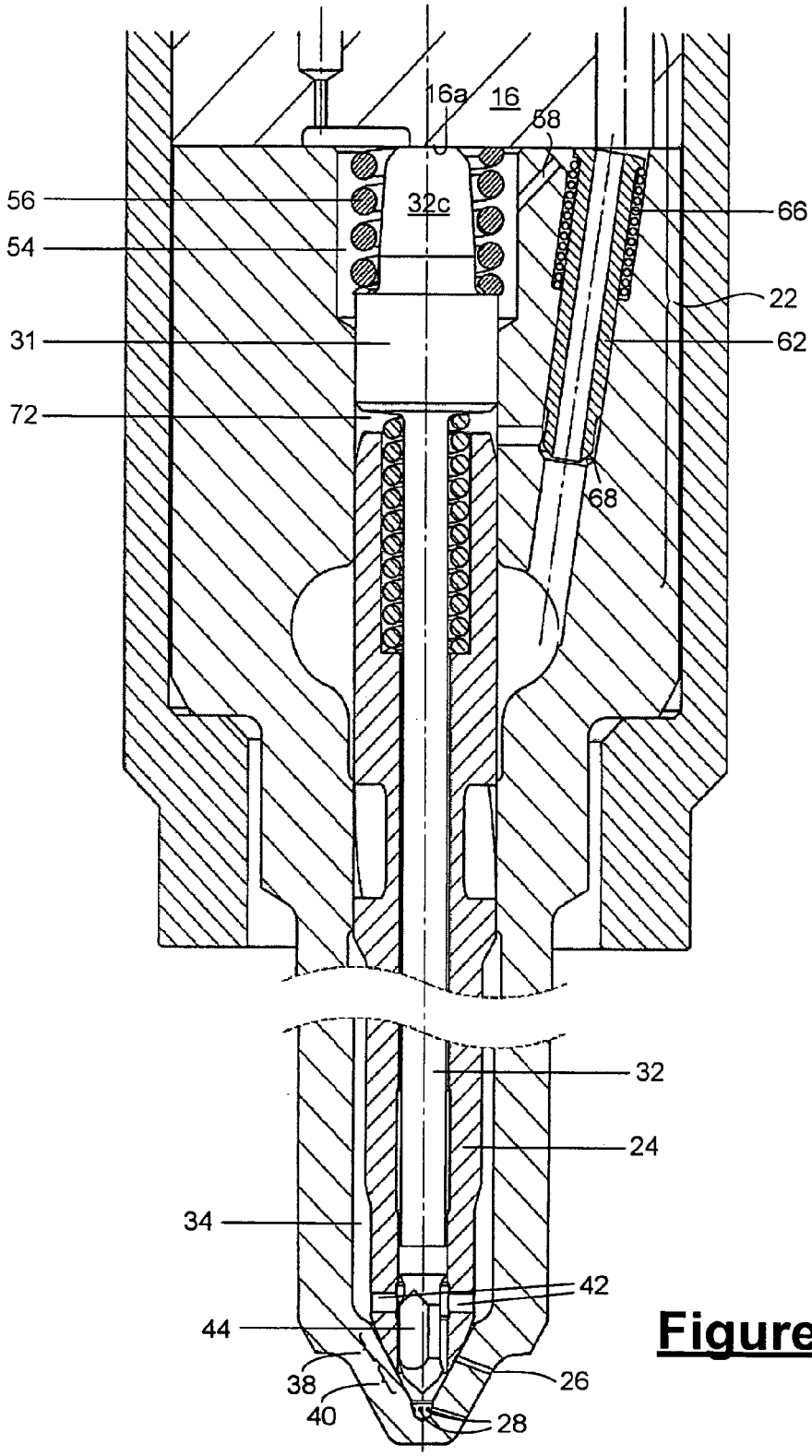
FIG. 2 shows the injection nozzle in FIG. 1 when in a first injecting state in which fuel is injected only through a first set of nozzle outlets.

A further difference between the embodiment of FIGS. 1 to 3 and that of FIGS. 4 to 6 is that the inner valve needle 32 in the latter case comprises separate and distinct upper and lower parts, 32*a*, 32*b* respectively. The lower part 32*b* of the inner valve needle 32 includes an elongate upper region 32*c*, an intermediate collar 32*d* and a lower end having substantially the same form as the inner valve needle in FIGS. 1 to 3 (i.e. with flats 44 to provide a flow route for fuel and the part spherical head of the lower part 32*b*). The upper part 32*a* of the inner valve needle 32 is carried by, or coupled to, the lower part 32*b* in a secure manner by means of welding or screwing the elongate region of the lower part 32*b* into a blind bore 78 formed in the upper part 32*a*. Alternatively, the elongate region of the lower part 32*b* of the inner valve needle 32 may form an interference fit within the upper part 32*a*.

The internal bore 130 of the outer valve 24 carries an annular member 76, preferably in a press-fit, which serves to urge the inner valve needle 32 into engagement with the inner valve seat 40. This is achieved by virtue of a lower surface of the annular member 76 being in abutment with an upper surface of the inner valve collar 32*d* when the nozzle adopts the non-injecting state shown in FIG. 4.

Referring to FIG. 5, in order to provide a first stage of injection, fuel at a first relatively lower pressure level is supplied to the supply passage 22. The first pressure level is selected to be an injectable pressure level, but is not so high as to generate a sufficient force to close the switching valve 62 against the switching valve seat 68. As a result, communication is maintained between the high pressure supply passage 22 and the switching chamber 72. If fuel pressure within the control chamber 54 is reduced to below the control chamber threshold level by actuating the control valve, the outer valve 24 will lift away from the outer valve seat 38, thereby allowing fuel to flow through the first outlets 26 into the engine cylinder. However, as the switching chamber 72 remains at relatively high pressure due to the open switching valve member 62, the inner valve 32 remains seated against the inner valve seat 40. Fuel injection therefore occurs through only the first outlets 26.

With the outer valve 24 lifted away from the outer valve seat 38 but the inner valve needle 32 seated, the annular member 76 carried by the outer valve 24 is moved with the outer valve 24 to disengage from the inner valve collar 32*d*, but does not move so far as to close the gap between the upper surface of the annular member 76 and the lower surface of the upper valve needle part 32*a* completely. Thus, the inner valve needle 32 remains seated during this first injection stage.

Referring to FIG. 6, in order to provide a second stage of injection, fuel at a second higher pressure level is supplied to the supply passage 22. As in the previous embodiment, higher pressure fuel in the supply passage 22 causes the switching valve member 62 to be seated against the switching valve seat 68, hence closing communication between the supply passage 22 and the switching chamber 72. Fuel therefore becomes trapped within the switching chamber 72 so that if the control valve is actuated to decrease pressure in the control chamber 54, the resulting increase in volume of the switching chamber 72 as the outer valve 24 lifts results in the inner valve needle 32 being drawn away from the inner valve seat 40 to open the second outlets 28. In such circumstances, fuel injection therefore occurs through both the first and second outlets 26, 28.

In order to terminate injection the same method is applied as described for the embodiment of FIGS. 1 to 3. Thus, the control valve is actuated to re-establish high pressure fuel within the control chamber 54, thereby urging the outer valve 24 into engagement with its seat 38. With fuel pressure trapped within the switching chamber 72, closing movement of the outer valve 24 results in the inner valve needle 32 being moved also to seat against the inner valve seat 40.

In the same way as for the embodiment shown in FIGS. 1 to 3, the embodiment of FIGS. 4 to 6 need not include a control valve but may be operated in a more conventional manner, whereby a pressure wave arriving in the delivery chamber 34 causes opening of the outer valve 24. Here, the injection nozzle may form part of a so-called unit injector, as opposed to a common rail injector, where a dedicated fuel pump is provided to supply pressurised fuel to the nozzle.

Alternatively, and as described previously, the injection nozzle of FIGS. 4 to 6 may form part of a unit injector having a spill valve for controlling fuel pressure within the nozzle's dedicated pump chamber (and hence the pressure of fuel delivered to the nozzle) and a control valve for controlling pressure in the control chamber 54.

Figure 7:
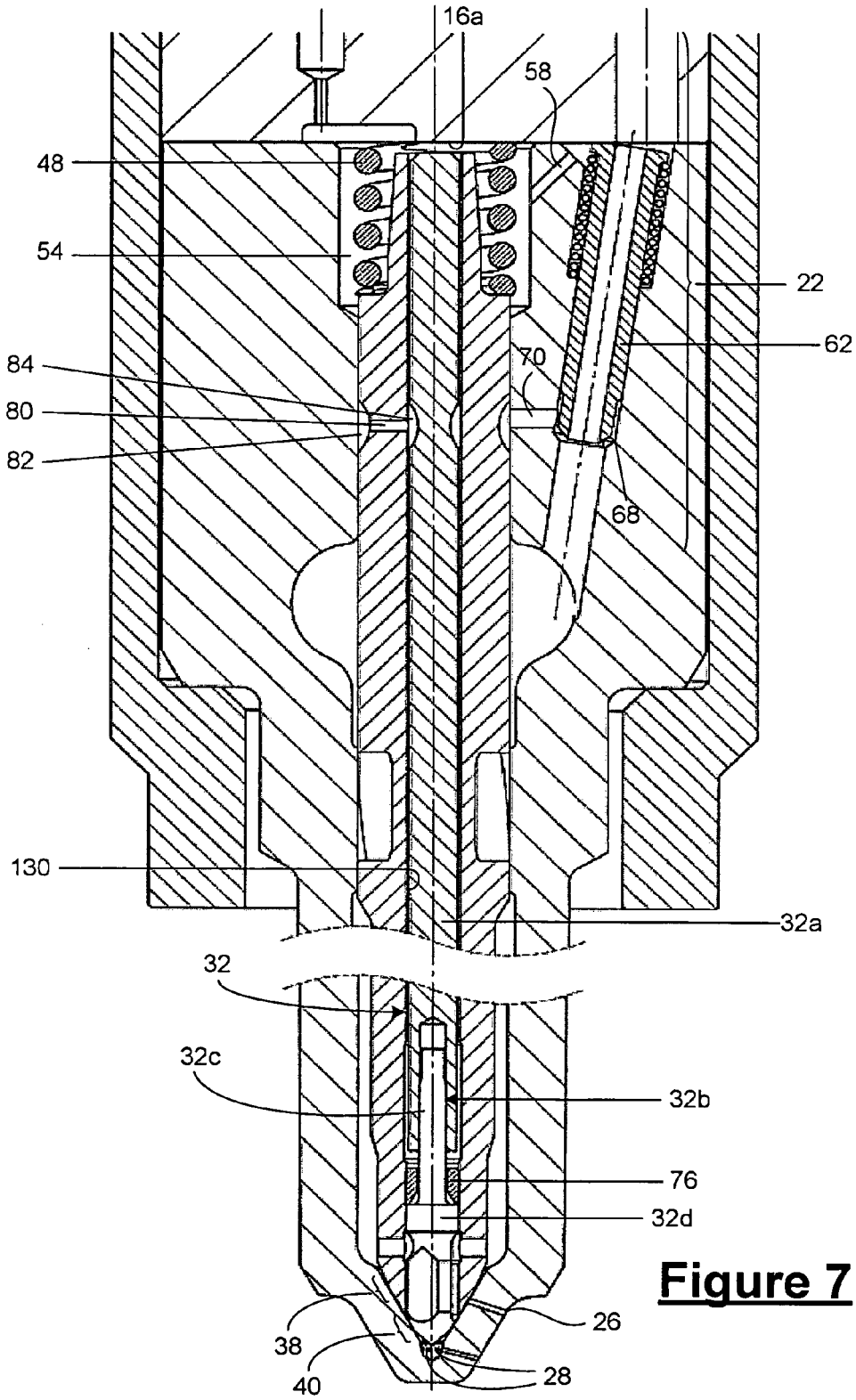
FIG. 7 is a schematic diagram of an injection nozzle of a third embodiment of the present invention when in a closed (non-injecting) state.
Figure 8:
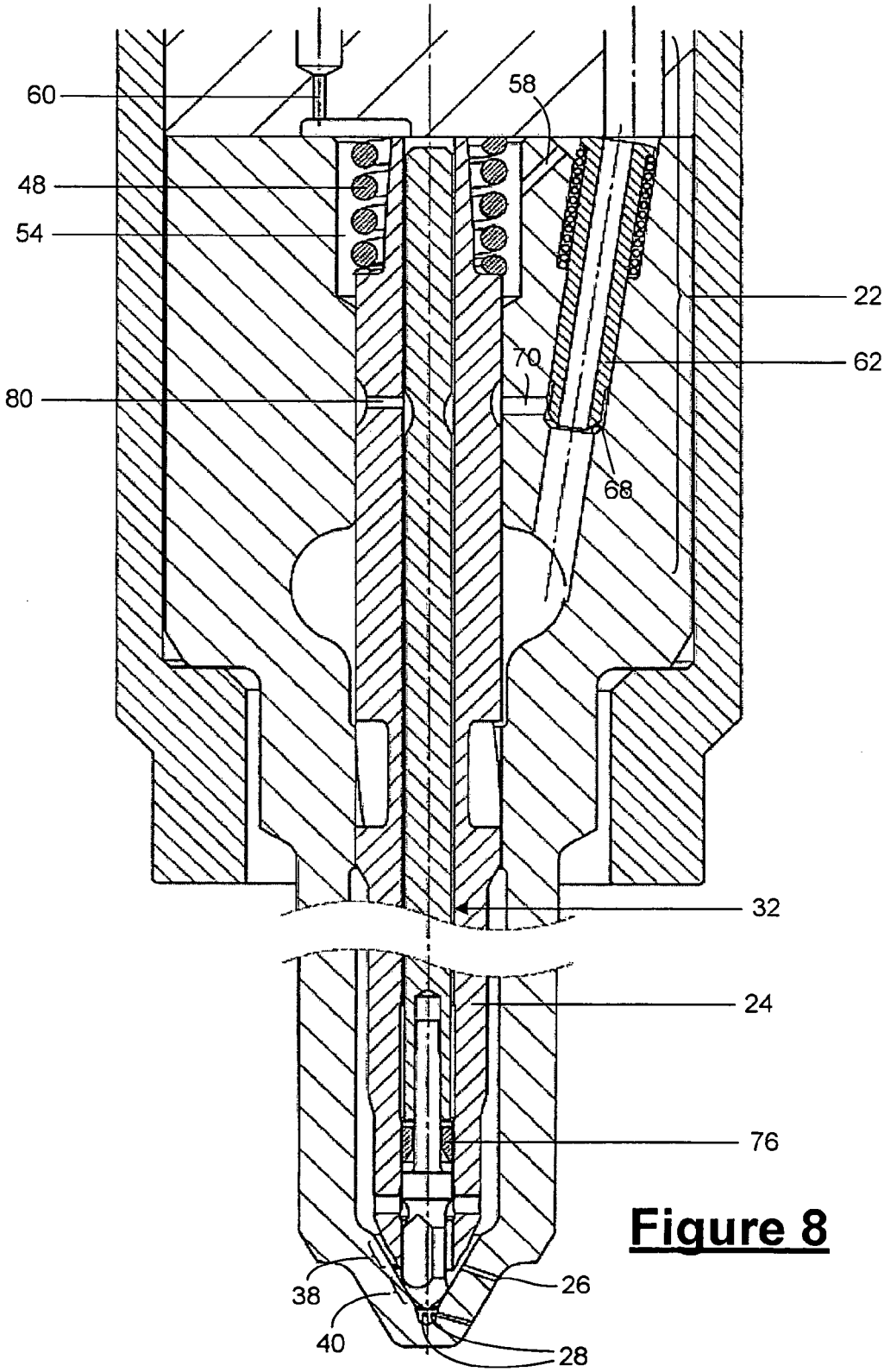
FIG. 8 shows the injection nozzle in FIG. 7 when in a first injecting state in which fuel is injected only through a first set of nozzle outlets.
Figure 9:
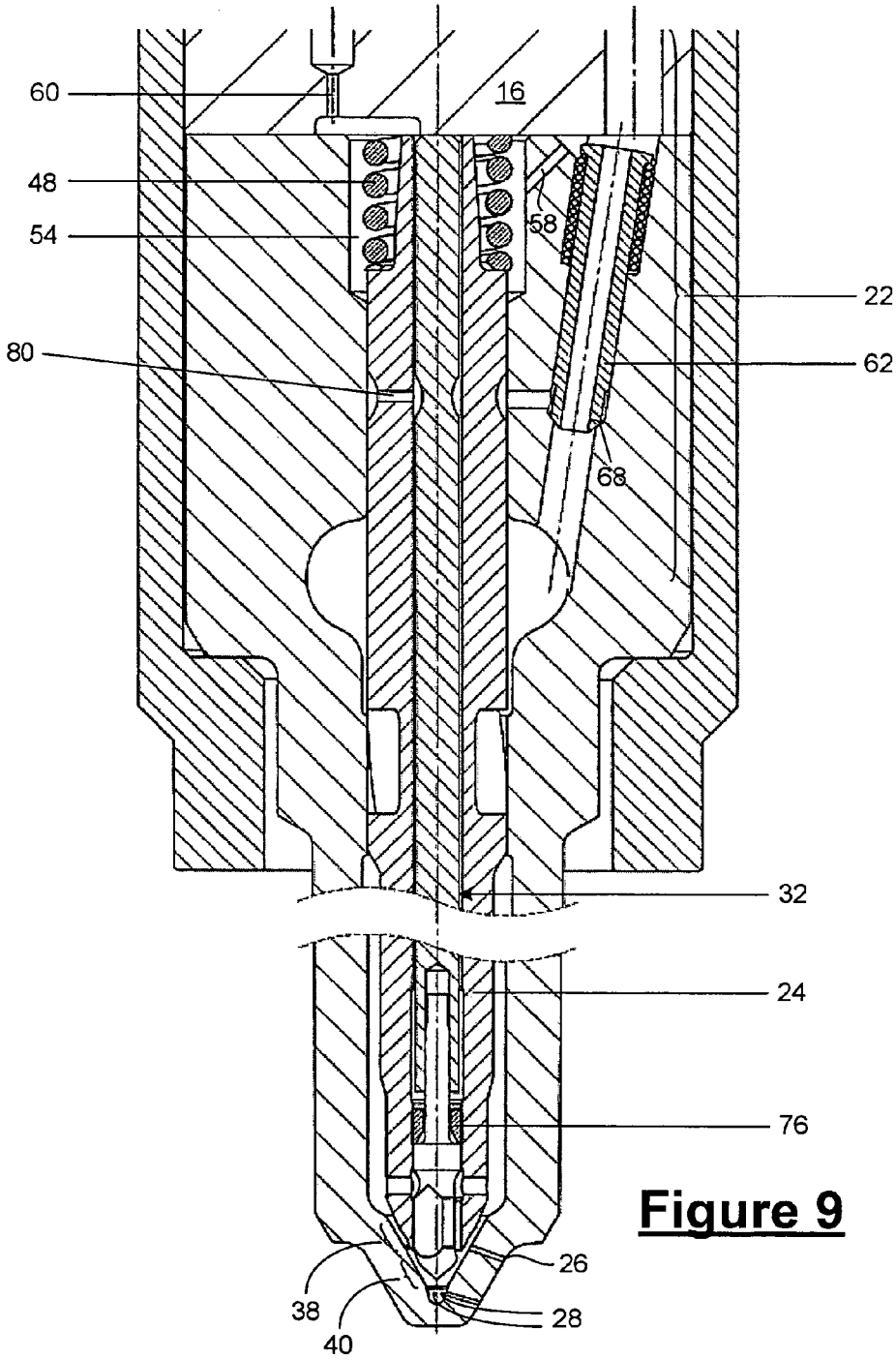
FIG. 9 shows the injection nozzle in FIGS. 7 and 8 when in a second injecting state in which fuel is injected through both a first and a second set of nozzle outlets together.

A further alternative embodiment is shown in FIGS. 7 to 9 in which a control valve (not shown) is provided to control fuel pressure in an injection nozzle control chamber 54, as described previously, with like parts to those shown in the preceding figures identified with like reference numerals. In this embodiment, there is no separate switching chamber, as such, as the inner valve needle 32 extends the full length through the outer valve bore 130, with its upper part 32*a* exposed to fuel pressure within the control chamber 54 in the same way as the outer valve 24. The lower part 32*b* of the inner valve needle 32 has the same construction as shown in FIGS. 4 to 6, namely an elongate upper region 32*c* and a collar 32*d*.

A further difference between the embodiment of FIGS. 7 to 9 and that of FIGS. 4 to 6 is that a further restricted drilling 80 (referred to as the third restricted drilling) is provided in the outer valve 24 to provide a flow path for fuel between the supply passage 20 and the control chamber 54 when the switching valve member 62 is open. The level to which pressure within the control chamber 54 can decease is determined not only by the first and second restricted drillings 58, 60, as described for the previous embodiments, but by the dimensions of the third restricted drilling 80 also. The third restricted drilling 80 communicates, at one end, with an outer annular chamber 82 defined by a groove in the outer surface of the outer valve 2. At its other end, the third restricted drilling 80 communicates with an inner annular chamber 84 defined by a groove in the upper region 32*a* of the inner valve needle 32.

In circumstances in which the switching valve member 62 is held away from the switching valve seat 68 under the biasing spring force, the outer annular groove 82 communicates with the supply passage 22 through the lateral drilling 70 and the third restricted drilling 80. The outer annular chamber 82 therefore only communicates with the supply passage 22 when the pressure of fuel delivered to the passage 22 is relatively low. In such circumstances, fuel is delivered to the control chamber 54, via the outer and inner annular chambers 82, 84, through the clearance between the inner valve needle 32 and the outer valve bore 130, as well as through the first restricted drilling 58.

The relative restrictions provided by the first, second and third restricted drillings 58, 60, 80 are selected so that, when the switching valve member 62 is open and fuel is able to flow through the third restricted drilling 80, fuel pressure in the control chamber 54 drops to a threshold level that is sufficiently low to allow the outer valve 24 to lift, as shown in FIG. 8, but is not so low as to allow the inner valve needle 32 to lift too (i.e. a net closing force remains on the needle 32). In such circumstances, fuel injection therefore only takes place through the first outlets 26, at a pressure level below the supply pressure threshold level.

As shown in FIG. 9, when the pressure of fuel delivered to the supply passage 22 is increased, the switching valve member 62 is caused to close against the switching valve seat 68 so that the additional flow path into the control chamber 54, through the third drilling 80, is closed. When this happens, the minimum level to which fuel pressure within the control chamber 54 can decrease is determined by the dimensions of the first and second restricted drillings 58, 60 only, as in the embodiment of FIGS. 1 to 3. Thus, when the control valve is actuated to open communication between the control chamber 54 and the low pressure drain, fuel pressure within the control chamber 54, which is no longer supplemented by fuel flowing through the third restricted drilling 80, reduces to a sufficiently low level to allow both the inner and outer valves 32, 24 to lift. A point will be reached, when the outer valve 24 has fully opened and engaged with the stop surface 16*a*, when the inner valve needle 32 is also caused to move away from the inner valve seat 40. In such circumstances, both the first and second outlets 26, 28 are caused to open so that a greater fuel flow area is presented to fuel being delivered to the engine cylinder. In this second stage of injection the fuel pressure delivered through the outlets 26, 28 is at a second, higher pressure level.

The embodiment of FIGS. 7 to 9 may be used, in particular, when it is desired to have a significant delay between the opening of the outer valve 24 (to allow injection through the first outlets 26 only) and the opening of the inner valve needle 32 (to allow injection through both the first and second outlets 26, 28 together). The reason for this delay is that the inner valve needle 32 cannot begin to lift until the outer valve 24 has fully lifted and engages with the stop surface 16*a*. The delay between opening of the outer valve 24 only, and subsequent opening of the inner valve needle 32, is beneficial as it allows a "boot-shaped" injection profile to be achieved which has been found to be advantageous for low engine emissions.

It will be appreciated that, although not described in detail, it is possible to operate the embodiments of FIGS. 7 to 9 without a control chamber 54 and a control valve, but by relying on pressure waves arriving at the nozzle to open the valves (as in a unit injector).

The embodiments described previously include a hydraulically controlled switching valve arrangement which permit selective fuel injection through either one set of outlets on its own, by opening only one of the nozzle valves (the first set of outlets being opened by the outer valve or the second set of outlets being opened by the inner valve needle), or both sets of outlets together (when both the inner and outer valves are open). Other modifications are also envisaged, without departing from the scope of the invention set out in the accompanying claims. For example, although in the embodiment described in FIGS. 1 to 3 it is the spring force of the outer valve spring 48 that holds the outer valve 24 against the outer valve seat 38 and in FIGS. 4 to 6 it is the outer valve spring 48 acting through the annular member 76 that holds the inner valve needle 32 against the inner valve seat 40, alternative arrangements may be employed to provide the same effect. In the embodiment of FIGS. 1 to 3, for example, the inner valve needle 32 may be provided with an annular member 76 which co-operates with the outer valve 24 so as to hold it closed under the inner valve spring force, thereby removing the need for the outer valve spring 48. Also, in the embodiments of FIGS. 4 to 9, the annular member 76 may be removed from the outer valve bore 130 and the inner valve needle 32 may be provided with an inner valve spring to hold it against the inner valve seat 40. Furthermore, although the switching valve member is described and shown as a one-piece valve member, it could also be made as a multi-part component. For example, the valve member could carry one or more hardened surface regions to provide resilient seating surfaces.

The invention claimed is:

1. An injection nozzle for use in delivering fuel to an internal combustion engine, the injection nozzle comprising:

a supply passage for delivering fuel to first and second injection nozzle outlets, an outer valve that is engageable with an outer valve seat so as to control fuel delivery into the engine through the first nozzle outlet, an inner valve that is slidable within a bore provided in the outer valve and engageable with an inner valve seat so as to control fuel delivery into the engine through the second nozzle outlet, and a switching valve, for controlling whether only one of the first and second nozzle outlets or both of the first and second nozzle outlets together are open to allow delivery of fuel therethrough, wherein the switching valve is arranged within the supply passage and defines an inlet side, an outlet side and a flow passage to permit fuel to flow past the switching valve to the first and second nozzle outlets, wherein the switching valve is moveable between an open state and a closed state in response to a change in the pressure of the fuel supplied to the supply passage, wherein, in use, when the switching valve is in said open state, only one of the first and second nozzle outlets is open to allow delivery of fuel therethrough, and, when the switching valve is in said closed state, both of the first and second nozzle outlets together are open to allow delivery of fuel therethrough, and wherein the flow passage within the switching valve provides a conduit for fuel from the supply passage to the downstream regions of the nozzle both when the switching valve is open and when the switching valve is closed.

2. The injection nozzle as claimed in claim 1, wherein the flow passage includes an internal flow passage defined by the switching valve to allow fuel to flow to the first and second nozzle outlets.

3. The injection nozzle as claimed in claim 1, wherein the switching valve includes a biasing spring that serves to urge a switching valve member away from a switching valve seat.

4. The injection nozzle as claimed in claim 1, wherein the outer valve is urged into engagement with the outer valve seat by means of an outer valve spring.

5. The injection nozzle as claimed in claim 4, wherein the outer valve carries an annular member in the outer valve bore through which the force of the outer valve spring is applied to the inner valve to hold the inner valve against the inner valve seat.

6. The injection nozzle as claimed in claim 1, wherein the switching valve is configured for controlling whether only the second nozzle outlet or both of the first and second nozzle outlets together are open to allow delivery of fuel therethrough, and wherein the inner valve is urged into engagement with the inner valve seat by means of an inner valve spring.

7. The injection nozzle as claimed in claim 6, wherein the inner valve carries an annular member through which the force of the inner valve spring is applied to the outer valve by means of an outer valve spring to hold the outer valve against the outer valve seat.

8. The injection nozzle as claimed in claim 1, wherein the switching valve is operable between said open state and said closed state so as to initiate movement of only one of the inner and outer valves when fuel pressure delivered to the supply passage is below a supply pressure threshold level and so as to move both the inner and outer valves together when fuel pressure delivered to the supply passage is increased above the supply pressure threshold level.

9. The injection nozzle as claimed in claim 8, wherein the switching valve is operable between the open and closed states so as to control communication between the supply passage and a switching chamber.

10. The injection nozzle as claimed in claim 9, whereby when the switching valve is in the open state the switching chamber communicates with the supply passage through a drilling provided in a nozzle housing.

11. The injection nozzle as claimed in claim 9, whereby movement of the outer valve away from the outer valve seat is initiated upon generation of a pressure wave within the injection nozzle and, in circumstances in which the switching valve is closed, said movement causes the inner valve to move away from the inner valve seat also.

12. The injection nozzle as claimed in claim 9, wherein at least one of the inner and outer valves has a surface associated therewith that is exposed to fuel pressure within an injection nozzle control chamber such that changes in fuel pressure within the injection nozzle control chamber cause movement of the inner and outer valves.

13. The injection nozzle as claimed in claim 12, wherein the injection nozzle control chamber is arranged to communicate continuously with the supply passage through a first restricted flow path.

14. The injection nozzle as claimed in claim 13, wherein a second restricted flow path communicates with the injection nozzle control chamber, and whereby fuel flows out of the injection nozzle control chamber to a low pressure drain through the second restricted flow path.

15. The injection nozzle as claimed in claims 12, wherein an end of the inner valve is exposed to fuel pressure in the injection nozzle control chamber and whereby when the switching valve is in the open state and fuel pressure within the control chamber is reduced below a control chamber threshold level, the inner valve is caused to lift away from the inner valve seat whilst the outer valve remains seated, thereby to provide injection through only the second outlet.

16. The injection nozzle as claimed in claim 15, whereby when the switching valve is in the closed state and fuel pressure within the injection nozzle control chamber is reduced below the control chamber threshold level, movement of the inner valve away from the inner valve seat results in movement of the outer valve away from the outer valve seat also, thereby to provide injection through the first and second outlets together.

17. The injection nozzle as claimed in claim 15, wherein the switching chamber is defined between an upper surface of the outer valve and a facing surface of the inner valve.

18. The injection nozzle as claimed in claim 17, wherein the facing surface of the inner valve is defined by a collar carried by, or forming a part of, the inner valve.

19. The injection nozzle as claimed in claim 12, wherein an end of the outer valve is exposed to fuel pressure in the injection control chamber and whereby when the switching valve is in the open state and fuel pressure within the injection nozzle control chamber is reduced below the control chamber threshold level, the outer valve is caused to lift away from the outer valve seat whilst the inner valve remains seated, thereby to provide injection through only the first outlet.

20. The injection nozzle as claimed in claim 19, whereby when the switching valve is in the closed state and fuel pressure within the injection nozzle control chamber is reduced below the control chamber threshold level, movement of the outer valve away from the outer valve seat results in movement of the inner valve away from the inner valve seat also, thereby to provide injection through the first and second outlets together.

21. The injection nozzle as claimed in claim 19, whereby when the switching valve is in the open state the switching chamber communicates with the supply passage through a drilling provided in the outer valve.

22. The injection nozzle as claimed in claim 19, wherein the switching chamber is defined within the outer valve.

23. The injection nozzle as claimed in claim 1, wherein the switching valve is operable to control communication between the supply passage and an injection nozzle control chamber.

24. The injection nozzle as claimed in claim 23, wherein a surface associated with the outer valve and a surface associated with the inner valve are exposed to fuel pressure within the injection nozzle control chamber.

25. The injection nozzle as claimed in claim 24, wherein the injection nozzle control chamber is arranged to communicate continuously with the supply passage through a first restricted flow path.

26. The injection nozzle as claimed in claim 25, wherein the injection nozzle control chamber communicates with a low pressure drain by way of a second restricted flow path, and whereby fuel flows out of the injection nozzle control chamber to a low pressure drain through the second restricted flow path.

27. The injection nozzle as claimed in claim 26, wherein the supply passage communicates with the injection nozzle control chamber, in circumstances in which the switching valve is open, via a restricted flow path.

28. The injection nozzle as claimed in claim 27, wherein the restricted flow path is a third restricted flow path defined in the outer valve.

29. The injection nozzle as claimed in claim 28, whereby the restrictions to fuel flow presented by each of the first, second and third restricted flow paths are selected such that, in circumstances in which the switching valve is in the open state, the outer valve only is caused to move away from the outer valve seat and, in circumstances in which the switching valve is in the closed state, the inner valve and the outer valve move together away from the respective inner and outer valve seats.

* * * * *